US005655662A

United States Patent [19]

Garcia

[11] Patent Number: 5,655,662

[45] Date of Patent: Aug. 12, 1997

[54] UNIVERSAL SYSTEM FOR PACKAGING THREE-DIMENSIONAL OBJECTS

[76] Inventor: Ana Tabuenca Garcia, Avda. Europa, 4, 28224 Pozuelo de Alarcon, Madrid, Spain

[21] Appl. No.: 468,146

[22] Filed: Jun. 6, 1995

[30] Foreign Application Priority Data

Oct. 18, 1994 [ES] Spain ..... 9402173

[51] Int. Cl.[6] ..... B65D 81/07

[52] U.S. Cl. ..... 206/583; 206/453; 206/455; 206/586; 220/1.5; 220/4.28

[58] Field of Search ..... 206/521, 320, 206/453, 454, 455, 583, 586, 591; 220/1.5, 4.28, 668; 248/610–611, 317

[56] References Cited

U.S. PATENT DOCUMENTS

| | | | |
|---|---|---|---|
| 2,653,709 | 9/1953 | Cunningham et al. . | |
| 2,779,464 | 1/1957 | Cairnes et al. | 206/583 |
| 3,044,656 | 7/1962 | Combs et al. | 220/1.5 |
| 3,955,702 | 5/1976 | Lundy | 220/4.28 |
| 3,966,285 | 6/1976 | Porch et al. . | |
| 4,013,170 | 3/1977 | Hutterer | 206/583 |
| 4,558,797 | 12/1985 | Mitchell | 220/1.5 |
| 4,574,955 | 3/1986 | Camossi . | |
| 4,664,254 | 5/1987 | Sitwell et al. | 206/453 |
| 4,877,136 | 10/1989 | Mizuno et al. | 206/521 |
| 5,259,523 | 11/1993 | Scherb | 206/583 |
| 5,285,902 | 2/1994 | Garcia . | |

FOREIGN PATENT DOCUMENTS

| | | |
|---|---|---|
| 0708032 | 7/1996 | European Pat. Off. . |
| 1057698 | 5/1959 | Germany . |
| 1661070 | 7/1991 | Russian Federation . |
| 901507 | 7/1962 | United Kingdom . |

*Primary Examiner*—Paul T. Sewell
*Assistant Examiner*—Luan K. Bui
*Attorney, Agent, or Firm*—Hedman, Gibson & Costigan, P.C.

[57] ABSTRACT

A collapsible transportation package has a framework formed in the shape of a rectangular prism by four longitudinal beams (1) connected to each other through two square end frames. The end flames are defined by four end pieces (2). This framework constitutes a structural strength element capable of receiving cover panels (10) spanning the faces of the prism and acting as independently removable closing elements. Fixed to the inner face of each longitudinal beam (1), through resilient dampers (16), is a secondary beam (17). Flexible straps (20) are provided between diagonally faced pairs of the secondary beams (17), which straps are designed to fully or partially suspend the packaged object within the container. The straps (20) are conveniently installed and removed with the assistance of removable rollers (19) couplable to pairs of spaced brackets (18) appropriately affixed to the secondary beams (17).

21 Claims, 7 Drawing Sheets

UNIVERSAL SYSTEM FOR PACKAGING THREE-DIMENSIONAL OBJECTS

BACKGROUND OF THE INVENTION

The present invention relates to transportation packaging systems. In particular, the invention relates to packaging systems designed to carry and store fragile or delicate objects requiring a high degree of protection from impacts, shocks, and vibrations. The present inventor is also the inventor of Spanish patent of invention application number 9101433, and U.S. Pat. No. 5,285,902 (which is hereby incorporated by reference in its entirety). These documents describe a packaging system devised for pictures, e.g., artistic works and the like, based upon a rectangular framework carrying a number of preferably flexible straps having clasps. The straps extend in generally flat loops between opposite sides of the framework. Inside portions of the loops impinge on outwardly facing edges of the object to be packaged, e.g. a picture, through U-shaped clamp halves. The clamp halves have padded linings preventing the clamp halves from damaging the picture.

Each annular strap is additionally assisted by a pair of clips, movable on the strap adjacent the clamp halves. The dips suitably stabilize the clamp halves against the picture, by adjustably pinching the fiat loop defined by each strap. The framework with its fittings is secured to the transportation vehicle directly or through vibro-insulating silent-bloc type supports, whereby the picture or object to be protected takes up a floating position within the packaging. In this manner, the picture or object is effectively isolated from shocks, impacts and vibrations.

Although this solution provides optimal carriage conditions for considerably flat and shallow bodies, for instance pictures as aforesaid, the system is not suitable for carrying sizeable three-dimensional objects, i.e., objects having a substantial thickness or depth dimension.

Systems are known for suspending sizeable three-dimensional objects to be transported within a packaging crate. Such systems typically employ elastic straps or springs emanating from opposing comers of the crate and secured to the object. An inherent disadvantage with such systems is that they depend upon substantial stretch of the straps or springs in order to absorb shock. As a result, it is necessary to provide an outer package which is substantially larger than the object to be transported.

So-called "floating" packages are also known, particularly for use in military applications. In these systems, inner walls of a box-shaped package for containing large objects are separated from outer walls of the package by resilient vibration and shock absorbing dampers comprising taut loops of relatively stiff cable passing through a pair of blocks mounted to the tuner and outer walls, respectively. These known containers are generally bulky and not easily collapsible to a small size for storage. Additionally, such containers may not provide adequate isolation of the packaged object(s) from impacts, shocks and vibrations, due to a lack of suitable means for suspending the packaged object(s) within the container.

SUMMARY OF THE INVENTION

An object of the invention is to provide a high degree of protection to fragile or delicate objects from impacts, shocks, vibrations, and the like, during transportation and storage of the same.

A further object of the invention is to provide a packaging system which is universal in the sense that it may be applied to objects having a wide range of shapes and sizes.

Still another object of the invention is to provide a packaging system that is reusable time and time again, and which is readily collapsible to a small size when not in use, thereby substantially diminishing the cost and space required for storage, and in particular carriage.

The packaging system of the present invention provides an extension of the basic idea of the inventor's previous patent, i.e., use of a framework, annular straps and damp halves for suspending a packaged object. The invention is a technological step forward in that it provides an optimal arrangement for carrying sizeable three-dimensional objects. For instance, the system is applicable to the carriage and storage of all kinds of delicate objects, including but not limited to works of art (such as sculptures), computer equipment, military material, radioactive matter, and medical gear.

The above and other objects are achieved in accordance with a first aspect of the invention by a package for transporting three-dimensional objects with protection against impacts, shocks and vibrations. The package comprises a framework defining an internal space and providing a pair of interior opposing surfaces, a pair of resilient vibration and shock absorbing dampers attached to respective ones of the interior opposing surfaces, and a strap extending in a path across said internal space between the opposing surfaces and being attached to the opposing surfaces through the pair of dampers. The strap is adjustable in length such that it can be securely affixed to an object positioned within the internal space.

In a second aspect, the invention is embodied in a collapsible reusable package for transporting three-dimensional objects. The package comprises a framework defining an internal space for receiving an object and serving as a structural strength element. The framework comprises a plurality of beams forming corners of a polyhedron and providing recessed shelves. The beams are removably connected to each other through separate corner-pieces. A plurality of cover panels are removably attached within the framework on the recessed shelves.

In a third aspect, the invention is embodied in a beam for use in constructing a framework of a collapsible reusable package. The beam comprises a first tubular section having a quadrangular cross-sectional shape for receiving therein a separate corner piece used to connect the beam with other beams, and a second tubular section adjacent the first tubular section. The second tubular section has a triangular cross-sectional shape. A hypotenuse side of the second tubular section serves as an attachment point for securing an object to be transported within the package. The first and second tubular sections form therebetween a recessed shelf for supporting an edge of a removable cover panel of the package.

In a fourth aspect, the invention is embodied in a mounting member for use in a package for transporting three-dimensional objects. The mounting member comprises a roller assembly providing a cylindrical support surface about which an object securing strap can be wrapped. The roller assembly comprises a pair of spaced brackets providing two coaxial holes, a roller having a longitudinal bore and a longitudinal slot opening to an outer circumferential surface of the roller, and into the longitudinal bore, and a pair of retractable bolts extending within and protruding from the longitudinal bore. The bolts are biased outwardly by, and retractable against, a spring positioned therebetween and within the longitudinal bore. The retractable bolts have attached thereto finger tabs movable within the longitudinal slot to retract the bolts from the coaxial holes of the brackets, to thereby permit the roller to be removed from the brackets.

These and other objects, features and advantages of the present invention will be apparent and fully understood from the following detailed description of the preferred embodiments, taken in connection with the appended drawings.

DETAILED DESCRIPTION OF THE PREFERRED EMBODIMENTS

Figure 1:
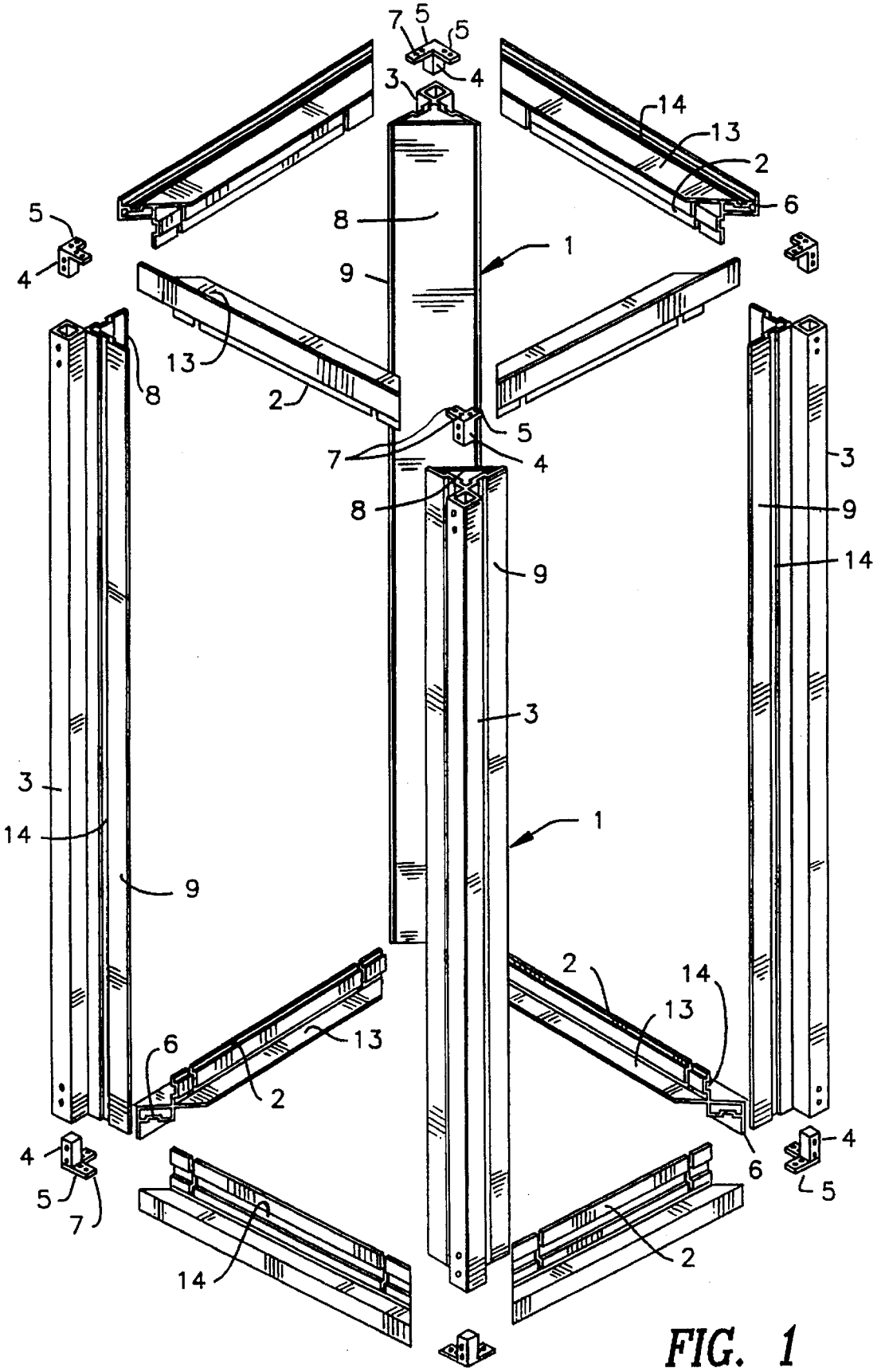
FIG. 1 is an exploded perspective view of the constituent parts of a framework used in a packaging system in accordance with the present invention.
Figure 2:
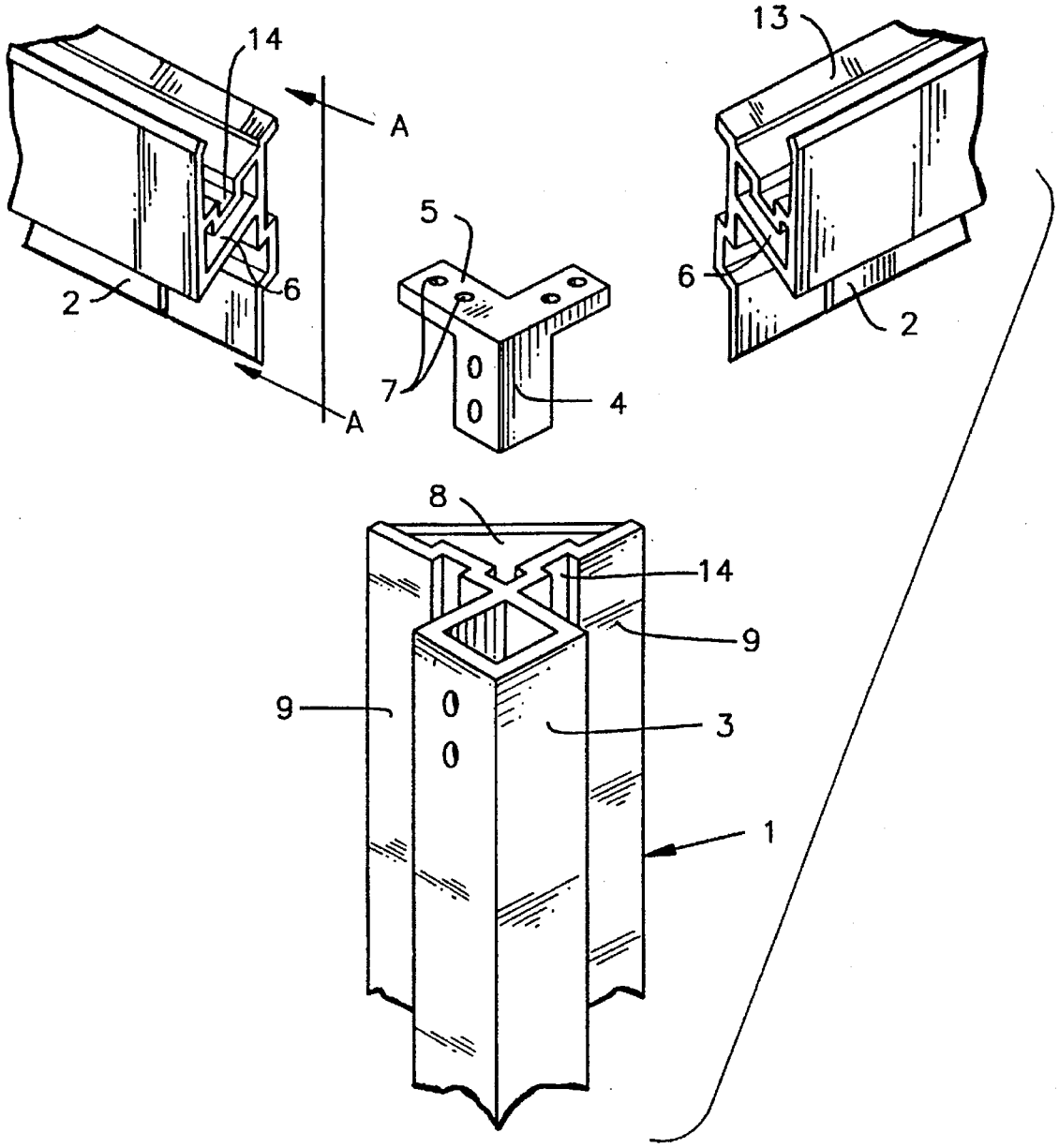
FIG. 2 is an enlarged exploded perspective view of a corner assembly of the framework depicted in FIG. 1.
Figure 2A:
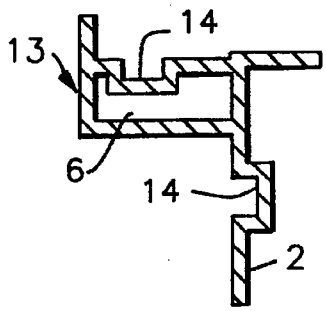
FIG. 2A is an end elevational view taken in the direction of arrows A—A in FIG. 2, showing the cross-sectional shape of the framework end pieces.

Referring first to FIGS. 1, 2, and 2A, a transportation package in accordance with the present invention comprises a preferably metal outer framework having the shape of a polyhedron. In the exemplary illustrated embodiment, the polyhedron is a rectangular prism. The framework is formed by four longitudinal beams 1 connected to each other through two square end frames. Each end frame is defined by four end pieces 2. Beams 1 each have a quadrangular tubular section 3 into which a correspondingly shaped arm or core 4 of a corner-piece is tightly fitted. Each corner-piece has two prismatic-rectangular arms or cores 5 lying at 90° with respect to each other, and to core 4. Arms 5 are respectively designed to be tightly coupled within correspondingly shaped tubular sections 6 of each end piece 2. The longitudinal beams and end-pieces making up the framework are removably affixed to each other using screws passed through holes 7.

As an alternative to corner-pieces having a core 4 and arms 5 designed to be inserted into tubular sections 3 and 6 of beams 1 and end pieces 2, respectively, the corner-pieces could be provided as similarly shaped externally mounted corner-capping members.

Figure 3:
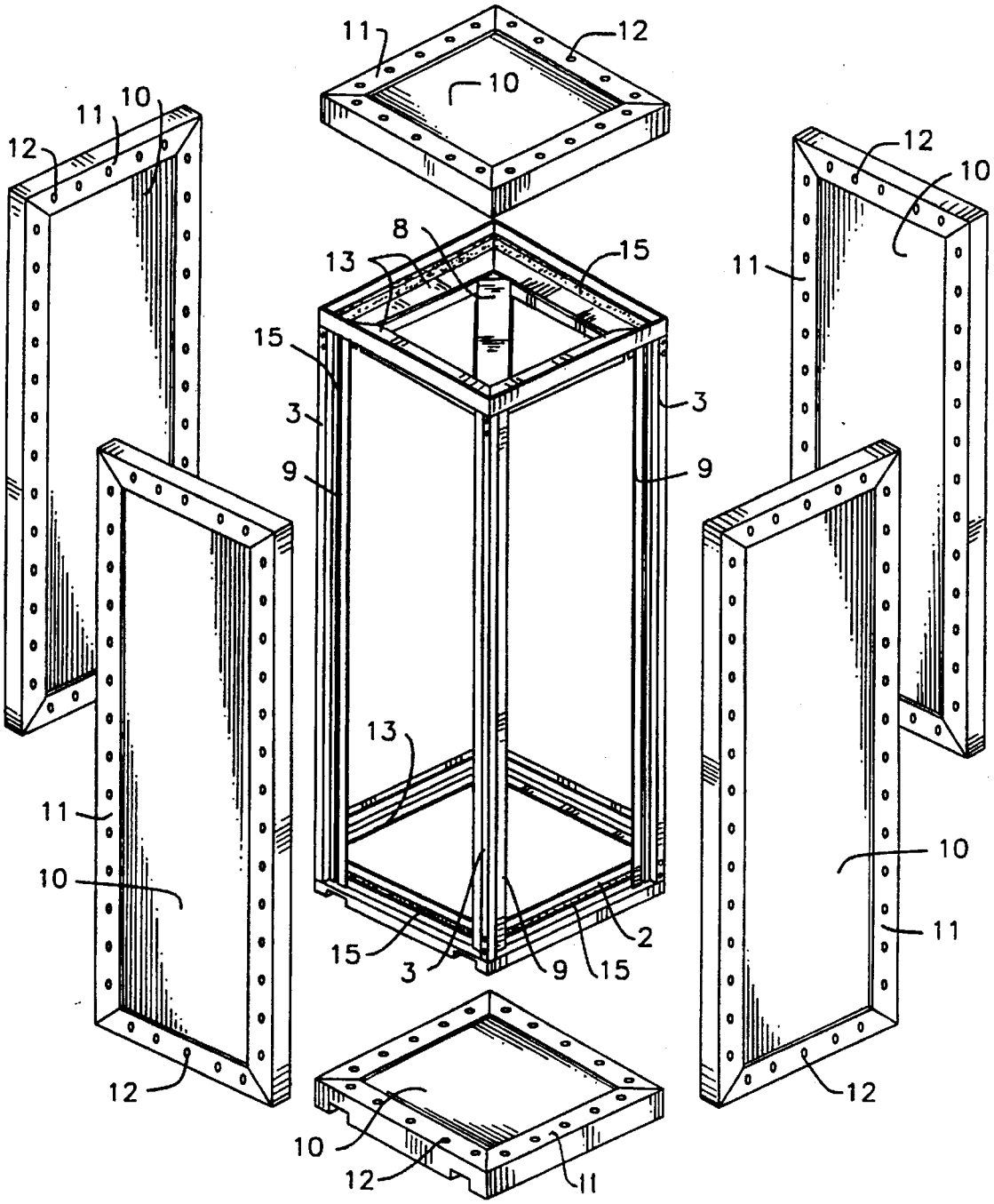
FIG. 3 is a perspective view of the FIG. 1 framework in an assembled state, and showing also associated cover panels.

In addition to tubular section 3, beams 1 comprise another tubular section 8. Sections 8 support elements (to be described) used to suspend an object in the package. Sections 8 also define recessed shelves 9 for flushly receiving four closing side panels 10 (see FIG. 3). Side panels 10 are suitably structured of sheet material (e.g., metal) carried within a perimetric reinforcement frame 11. Panels 10 are removably secured to the framework by screws or other suitable fasteners inserted in holes 12. End pieces 2 each carry an inwardly directed recessed shelf 13, as clearly shown in FIG. 2. This allows opposite end panels 10 to sit flush within the end frames. End pieces 2 also have a lower recessed shelf (the immediate structure pointed to by lead line 2) allowing the ends of panels 10 to rest flushly within the framework. Advantageously, panels 10 can be assembled and disassembled from the framework without affecting the structural integrity of the framework or the attachment of the packaged object therein.

All of the aforementioned recessed shelves have elongated shallow channels 14 for receiving respective sealing gaskets 15. This ensures that the panels 10 are sealed tightly to the framework.

Figure 4:
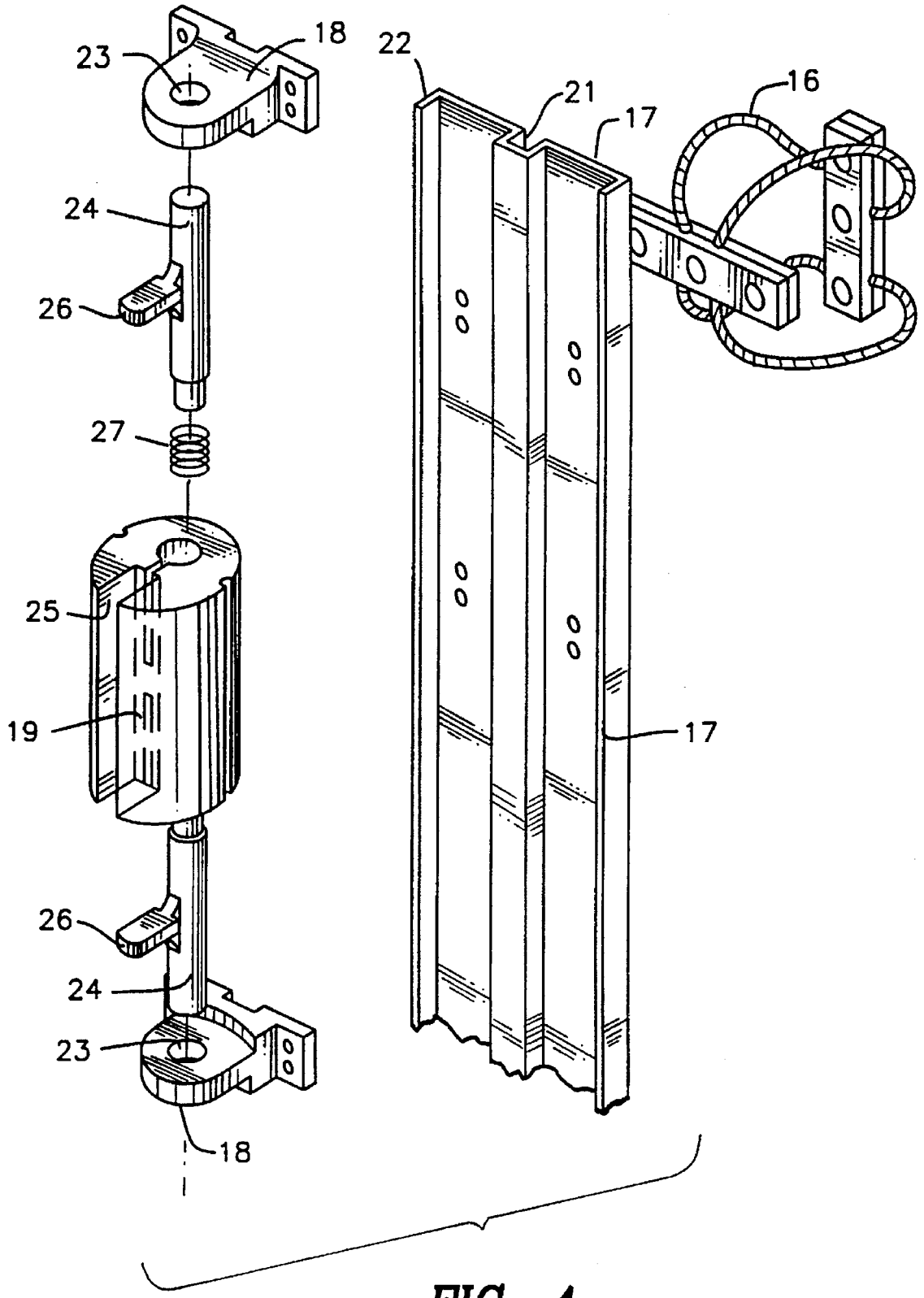
FIG. 4 is an exploded view of a damping arrangement associated with each of the longitudinal beams of the framework.
Figure 5:
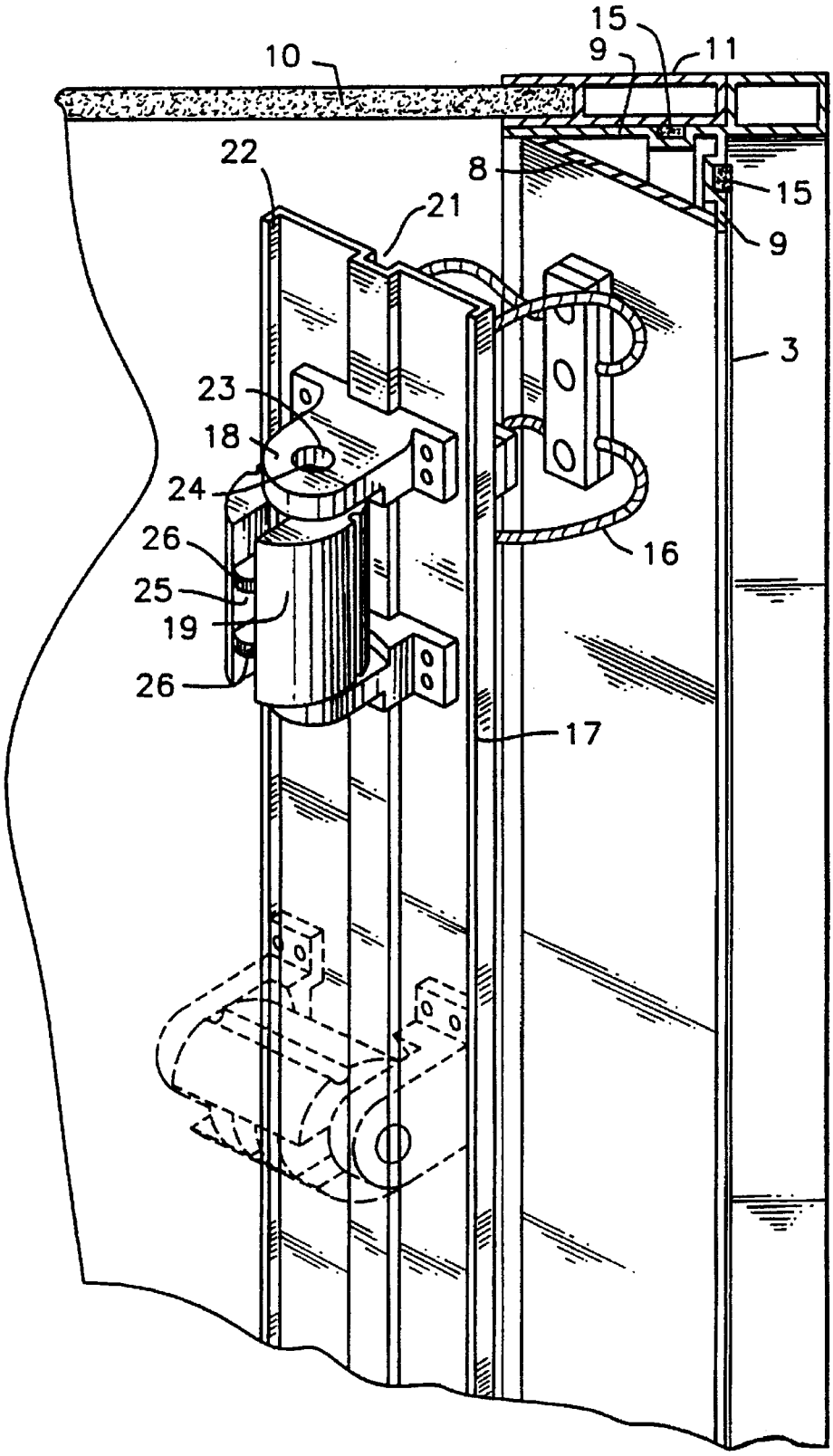
FIG. 5 is a perspective view of the parts shown in FIG. 4, assembled and coupled to one of the longitudinal beams of the framework.
Figure 6:
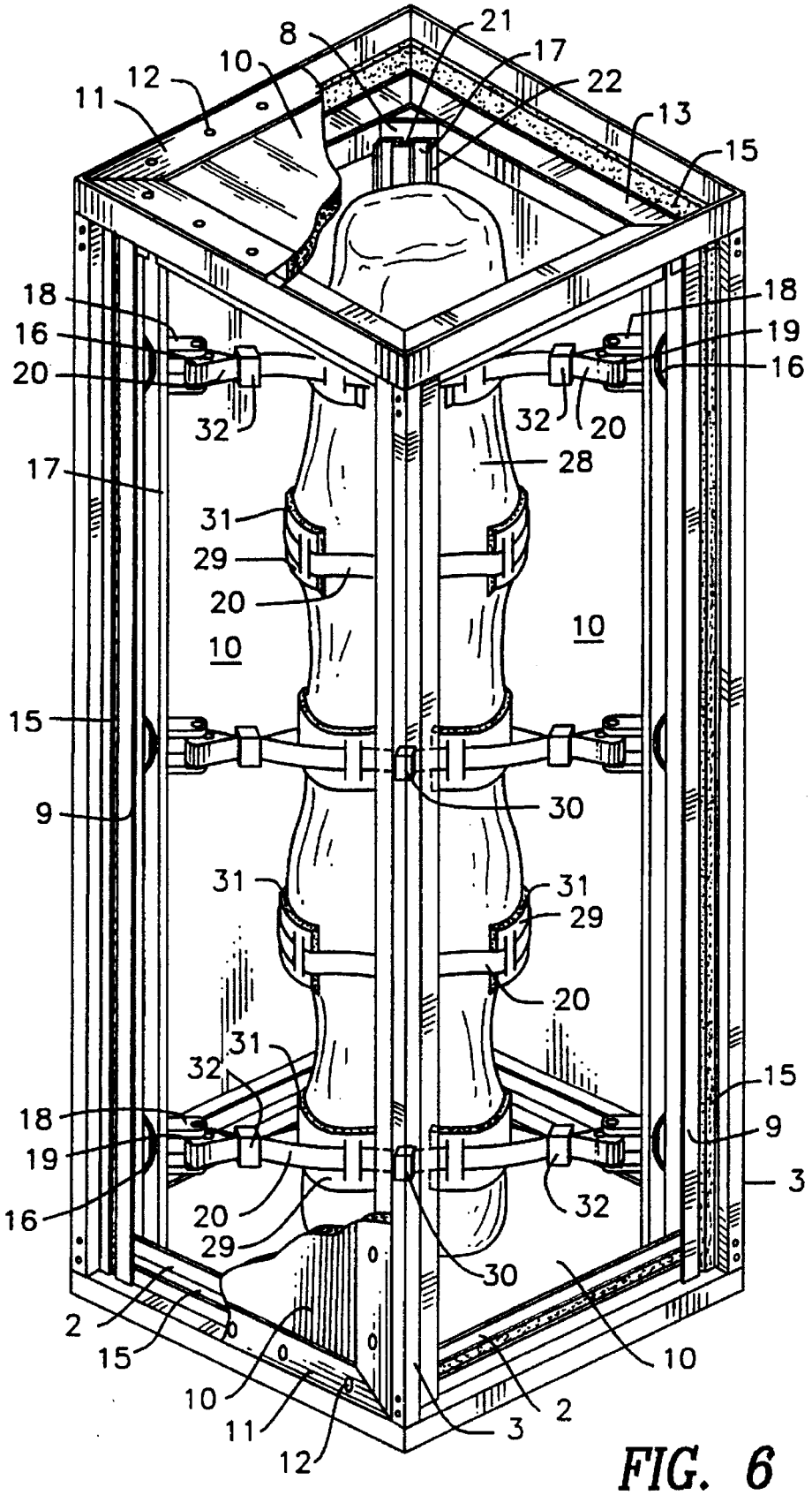
FIG. 6 is a perspective view of the inventive packaging system with the cover panels removed to show the support of an object inside.

Referring now to FIGS. 4 and 5, tubular sections 8 of beams 1 are preferably formed with cross-sectional shapes of isosceles right triangles, the hypotenuse sides of which have attached thereto at least a pair of resilient vibration and shock absorbing dampers 16 of the same general type used in the aforementioned "floating" packages (see the Background section). Dampers 16 comprise a taut loop of relatively stiff cable passing through a pair of blocks. One block is secured to the hypotenuse side of each section 8, while the other is secured to a secondary beam 17. Each secondary beam can have a length approximately equal to the length of beams 8 (as shown), or equal to the longest distance anticipated between the end points of attachment to the object to be packaged. In another possible arrangement, a relatively short secondary beam, i.e., a non-elongated plate, could be provided adjacent each point of attachment to the packaged object. Each secondary beam 17 is designed to have attached thereto, preferably by screwing, one or more pairs of spaced supports, i.e., brackets 18. Each pair of spaced brackets 18 is designed to receive a roller 19 providing a supporting surface about which a loop of flexible strap 20 can be wrapped. (Obviously, the pairs of brackets 18 could be provided as single units rather than separate pieces.) The secondary beams and roller assemblies serve as mounting members through which flexible strap 20 is attached to the outer framework, through a respective damper 16.

As shown in FIG. 5, each pair of spaced brackets 18 can be horizontally or vertically aligned, depending upon which position is best suited for the desired orientation of respective flexible strap 20. In this connection, the secondary beams 17 each have a central longitudinal rib 21 received in a corresponding recess in each bracket 18, thereby allowing the brackets 18 to be accurately positioned when they are to be vertically aligned. Secondary beams 17 also have elbows 22 running along their opposed edges serving as spacing abutments for accurately positioning supports 18 when they are to be aligned crosswise, i.e., horizontally (as shown in phantom).

Brackets 18 have two coaxial holes designed to receive therein two retractable bolts 24 extending within and protruding from a longitudinal bore in roller 19. Each roller 19 has a longitudinal slot 25 opening to the roller's outer circumferential surface, and into the longitudinal bore. Finger tabs 26 attached to bolts 24 are slidable within slot 25 to retract bolts 24 from the coaxial holes of brackets 18 to allow the roller 19 to be removed. This provides a convenient means for attachment and detachment strap 20 thereto. Tabs 26 ride within and are accessible through longitudinal slot 25. The bolts 24 are biased outwardly by, and retractable against, a common spring 27 positioned therebetween and within the longitudinal bore.

Similar to the arrangement disclosed in the inventor's earlier U.S. Pat. No. 5,285,902, each flexible strap 20 clamps the object 28 at the most suitable height, with the assistance of U-shaped clamp halves 29 duly linked thereto. Each of clamp halves 29 has a padded or cushioned face 31. Each flexible strap is closed by a clasp 30 and carries a pair of pinching clips 32 fostering adjustment of each strap to the object 28. As used herein, the term "strap" includes, in addition to flat strip-like members as shown, other like flexible members providing strength in tension, such as ropes, cords, wires and cables.

As an alternative to the illustrated and above-described embodiment wherein removable rollers are removably mounted between spaced brackets affixed to a generally flat secondary beam, the secondary beams could be provided as cylindrical rods having mounted thereon spool-like collars serving as wrapping locations for the flexible strap loops.

Figure 7:
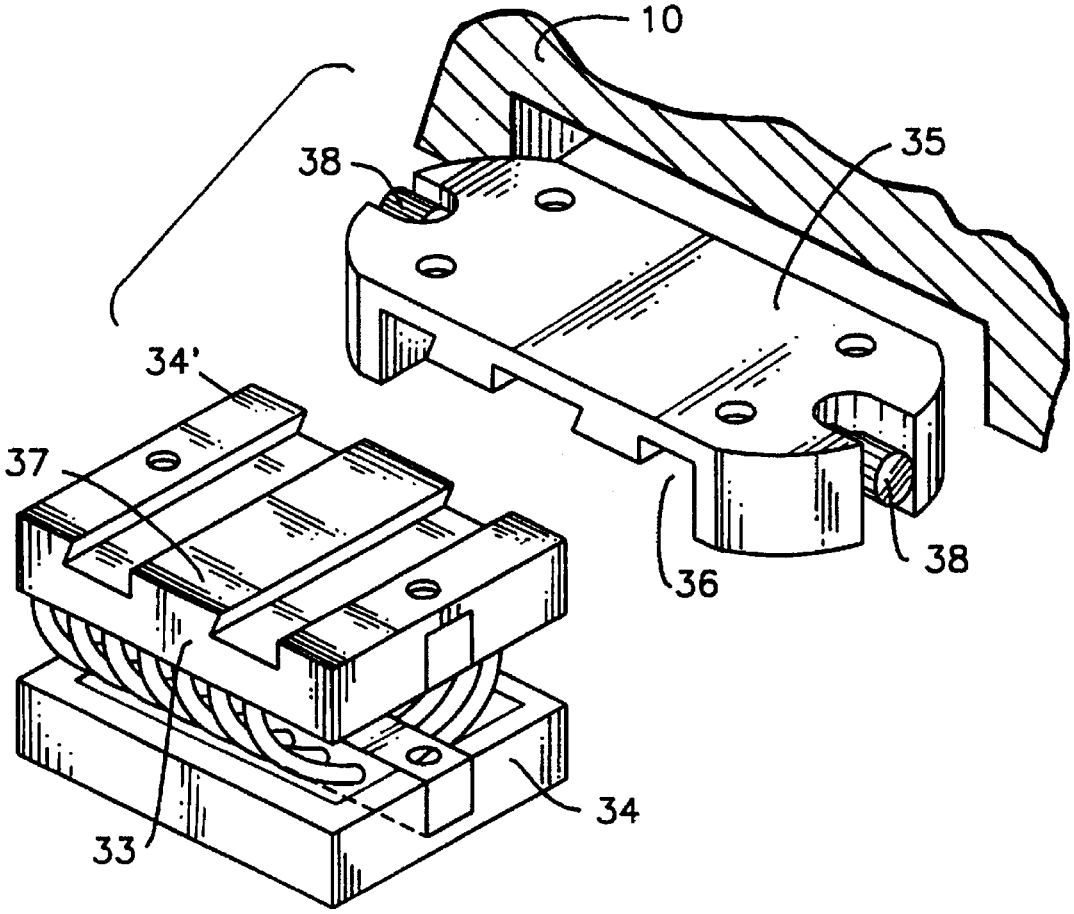
FIG. 7 is a close-up perspective view of a resilient support usable in the inventive packaging system.

The system may also include one or more resilient dampers 33 as shown in FIG. 7. Dampers 33 are designed to resist the weight of the packaged object, and enhance the dampening of impacts, shocks and vibrations, in the case that the object is not held in complete suspension. Dampers 33 comprise multiple taut loops of relatively stiff cable extending between a pair of blocks or plates 34 and 34'. Plate 34 is designed to constitute a damper support, and plate 34' is designed to receive the load of the packaged object. The load may be transferred to damper 33 either directly or through a secondary platform (not shown). The dampers may, e.g., be secured on the inner face of a cover 10 designed to constitute the container bottom or base, or, in accordance with what is deemed to be the most usual assembly, engaging the external or lower face of the cover for making direct contact with an external package support surface. In either case, the top plate 34' may be fitted with a receiving part 35 that is fixed within a recess provided in cover 10. Receiving part 35 has dovetail grooves 36 for tongue jointing with dovetail tongues 37 on plate 34'. In this manner, dampers 33 can be removed when not required. Dampers 33 are fixable in the assembled position with the assistance of thumb screw end retainers 38, or other suitable conventional means.

In accordance with the aforesaid construction, packaged object 28 may lie damped upon the base of the prismatic-rectangular package and be held substantially completely still sideways by straps 20. In other applications, the packaged object(s) will not lie damped upon the base of the package, but rather will be entirely suspended by straps 20. In either case, the object will be entirely accessible at all times through any of the faces of the package, inasmuch as panels 10 can be removed one by one independently, without affecting the structural rigidity of the framework or the means for attaching the object therein.

The present invention has been described in terms of preferred embodiments thereof. Other embodiments, features and variations within the scope of the appended claims will, given the benefit of this disclosure, occur to those having ordinary skill in the art.

I claim:

1. A package for transporting three-dimensional objects with protection against impacts, shocks and vibrations, said package comprising:

a framework defining an internal space and providing a pair of interior opposing surfaces;

a pair of resilient vibration and shock absorbing dampers attached to respective ones of said interior opposing surfaces; and a strap extending in a path across said internal space between the opposing surfaces and being attached to said opposing surfaces through said pair of dampers, said strap being adjustable in length such that it can be securely affixed to an object positioned within said internal space wherein at least one of said pair of dampers is connected to said strap through a mounting member comprising a cylindrical support surface about which the strap can be wrapped.

2. A package according to claim 1, wherein the mounting member comprises a roller assembly providing said cylindrical support surface.

3. A package according to claim 1, wherein at least one of said pair of dampers comprises a taut loop of relatively stiff cable passing through a pair of blocks.

4. A package according to claim 3, wherein one of said pair of blocks is attached to a respective one of said opposing surfaces, and the other of said pair of blocks is attached to said mounting member comprising a cylindrical support surface about which the strap can be wrapped.

5. A package according to claim 4, wherein the mounting member comprises a roller assembly providing said cylindrical support surface.

6. A package according to claim 1, wherein said framework is provided in the shape of a polyhedron.

7. A package according to claim 1, wherein said interior opposing surfaces are provided on beams forming opposed corners of the polyhedron.

8. A package according to claim 6, wherein said framework provides a second pair of opposed interior surfaces and said package further comprises:

a second pair of resilient vibration and shock absorbing dampers attached to respective ones of said second pair of interior opposing surfaces; and a second strap extending in a path across said internal space between the second pair of opposing surfaces and being attached to the second pair of opposing surfaces through said second pair of dampers, said second strap being adjustable in length such that it can be securely affixed to said object.

9. A package according to claim 6, wherein said framework provides a second pair of opposed interior surfaces and said package further comprises:

a second pair of resilient vibration and shock absorbing dampers attached to respective ones of said second pair of interior opposing surfaces; and a second strap extending in a path across said internal space between the second pair of opposing surfaces and being attached to the second pair of opposing surfaces through said second pair of dampers, said second strap being adjustable in length such that it can be securely affixed to said object.

10. A package according to claim 6, wherein said polyhedron is a rectangular prism formed by four beams connected to each other through two end flames.

11. A package according to claim 10, wherein said framework provides a second pair of opposed interior surfaces and said package further comprises:

a second pair of resilient vibration and shock absorbing dampers attached to respective ones of said second pair of interior opposing surfaces; and a second strap extending in a path across said internal space between the second pair of opposing surfaces and being attached to the second pair of opposing surfaces through said second pair of dampers, said second strap being adjustable in length such that it can be securely affixed to said object.

12. A package according to claim 11, wherein said first pair of opposed interior surfaces are provided on a first pair of said four beams forming first opposed comers of the rectangular prism, and said second pair of opposed interior surfaces is provided on a second pair of said four beams forming second opposed comers of the rectangular prism.

13. A package according to claim 6, wherein said framework forms the corners of said polyhedron and provides recessed mounting locations for removable cover panels.

14. A package according to claim 7, wherein said beams have sections having a triangular cross-sectional shape and the interior opposing surfaces are provided on respective hypotenuse sides of the beams.

15. A package according to claim 2, wherein the mounting member further comprises a plate to which said roller assembly is removably mounted, said plate having a guide means for allowing said roller assembly to be accurately positioned in either a vertical or horizontal alignment with respect to said plate.

16. A package according to claim 15, wherein said guide means comprises a rib centrally located on said plate and a corresponding recess in said roller assembly, and elbows running along the opposed edges of said plate.

17. A package according to claim 6, wherein said framework comprises a bottom cover panel, said bottom cover panel having a mounting member for removably attaching thereto a third resilient vibration and shock absorbing damper.

18. A package according to claim 17, wherein said mounting member on said bottom cover panel comprises a dovetail joint element.

19. A package according to claim 17, wherein said mounting member on said bottom cover panel is provided on an internal surface of said bottom cover panel.

20. A package according to claim 17, further comprising a third resilient vibration and shock absorbing damper, said third damper comprising multiple taut loops of relatively stiff cable extending between a pair of plates, one of said plates having a dovetail joint element for mating with a corresponding dovetail joint element of said mounting member on said bottom cover panel.

21. A package according to claim 1, wherein said strap is a looped strap closed upon itself with the assistance of a clasp, and has mounted thereon padded clamp halves for contacting the object and pinching clips for adjusting the strap to the object.

* * * * *